US010926390B2

(12) United States Patent
Dittrich et al.

(10) Patent No.: US 10,926,390 B2
(45) Date of Patent: Feb. 23, 2021

(54) FUEL-OPERATED FIRING DEVICE AND METHOD FOR OPERATING A FIRING DEVICE OF THIS TYPE

(71) Applicant: Hilti Aktiengesellschaft, Schaan (LI)

(72) Inventors: Tilo Dittrich, Feldkirch (AT); Daniel Jung, Munich (DE); Dominik Schmidt, Buchs (CH); Norbert Heeb, Buchs (CH); Thomas Demharter, Munich (DE)

(73) Assignee: Hilti Aktiengesellschaft, Schaan (LI)

( * ) Notice: Subject to any disclaimer, the term of this patent is extended or adjusted under 35 U.S.C. 154(b) by 312 days.

(21) Appl. No.: 16/063,772

(22) PCT Filed: Dec. 20, 2016

(86) PCT No.: PCT/EP2016/081910
§ 371 (c)(1),
(2) Date: Jun. 19, 2018

(87) PCT Pub. No.: WO2017/108782
PCT Pub. Date: Jun. 29, 2017

(65) Prior Publication Data

US 2020/0269405 A1 Aug. 27, 2020

(30) Foreign Application Priority Data

Dec. 22, 2015 (EP) ..... 15201897

(51) Int. Cl.
*B25C 1/18* (2006.01)

(52) U.S. Cl.
CPC ..... *B25C 1/18* (2013.01)

(58) Field of Classification Search
CPC ..... B25C 1/12; B25C 1/04; B25C 1/08; F02B 71/00; F02B 71/04; F02B 19/1052; F02B 19/1085; F02B 19/00; F02B 19/12
(Continued)

(56) References Cited

U.S. PATENT DOCUMENTS 4,913,331 A 4/1990 Utsumi et al.
6,755,159 B1 6/2004 Adams et al.
(Continued)

FOREIGN PATENT DOCUMENTS

DE 40 10 517 A1 10/1991
DE 42 43 617 A1 6/1994
(Continued)

OTHER PUBLICATIONS

International Bureau, International Search Report in International Application No. PCT/EP2016/081910, dated Mar. 21, 2017.

*Primary Examiner* — Nathaniel C Chukwurah

(74) *Attorney, Agent, or Firm* — Leydig, Voit & Mayer, Ltd.

(57) ABSTRACT

The invention relates to a fuel-operated firing device for driving securing elements into a substrate, comprising at least one main combustion chamber for a fuel, a driving piston that can be driven out of the main combustion chamber in a firing direction by expandable gases, and a pre-chamber with which an ignition device is associated and in which a pressure acting on the main combustion chamber can build up prior to a fuel-air mixture being ignited in said main combustion chamber. In order to improve the efficacy and/or functionality during the driving in of securing elements, a valve system is associated with the pre-chamber, by which valve system a maximum charge pressure in the pre-chamber can be varied in order to adjust the firing energy provided during the firing operation.

20 Claims, 11 Drawing Sheets

(58) Field of Classification Search
USPC ..... 227/8, 10, 130; 123/46 SC
See application file for complete search history.

(56) References Cited

U.S. PATENT DOCUMENTS

| | | | | |
|---|---|---|---|---|
| 6,830,017 | B2 * | 12/2004 | Wolf | B25C 1/08 123/46 R |
| 2004/0079302 | A1 | 4/2004 | Wolf et al. | |
| 2004/0144357 | A1 | 7/2004 | Adams | |
| 2005/0001000 | A1 | 1/2005 | Favre-Bulle et al. | |
| 2009/0250499 | A1 | 10/2009 | Hahn et al. | |
| 2010/0243699 | A1 * | 9/2010 | Largo | B25C 1/08 227/2 |
| 2011/0068141 | A1 * | 3/2011 | Wolf | B25C 1/08 227/9 |
| 2011/0204118 | A1 * | 8/2011 | Moeller | B25C 1/08 227/2 |
| 2016/0144497 | A1 | 5/2016 | Boehm et al. | |

FOREIGN PATENT DOCUMENTS

| | | | |
|---|---|---|---|
| DE | 102 32 035 | A1 | 1/2004 |
| DE | 103 27 191 | B3 | 12/2004 |
| EP | 2 106 883 | A1 | 10/2009 |
| EP | 2 826 601 | A1 | 1/2015 |
| WO | WO 2017/108772 | A1 | 6/2017 |
| WO | WO 2017/108787 | A1 | 6/2017 |

* cited by examiner

FUEL-OPERATED FIRING DEVICE AND METHOD FOR OPERATING A FIRING DEVICE OF THIS TYPE

CROSS-REFERENCE TO RELATED APPLICATIONS

This patent application is the U.S. National Stage of International Patent Application No. PCT/EP2016/081910, filed Dec. 20, 2016, which claims the benefit of European Patent Application No. 15201897.4 filed Dec. 22, 2015, which are each incorporated by reference.

TECHNICAL AREA

The invention relates to a fuel-operated firing device for driving securing elements into a substrate, comprising at least one main combustion chamber for a fuel, a driving piston that can be driven out of the main combustion chamber in a firing direction by means of expandable gases, and a pre-chamber with which an ignition device is associated and in which a pressure acting on the main combustion chamber can build up prior to a fuel-air mixture being ignited in said main combustion chamber. The invention furthermore relates to a method for operating such a firing device.

BACKGROUND OF THE INVENTION

A fuel-operated firing device for driving securing elements into a substrate is known from German published application DE 10 32 035 A1, comprising at least one main combustion chamber for a fuel, a driving piston mounted in a piston guide, which can be driven out of the main combustion chamber in a firing direction by means of expandable gases, and a pre-chamber, in which a pressure acting on the main combustion chamber can build up prior to a fuel-air mixture being ignited in said main combustion chamber, wherein the pre-chamber is formed by a room inside the piston guide, adjoining the lower side, which faces away from the main combustion chamber, of the driving piston located in its starting position, and wherein the pre-chamber is at least temporarily connected via a passage to the main combustion chamber, wherein a means for detecting the pressure is provided in the main combustion chamber, which means interacts with the ignition device for the main combustion chamber. A gas-operated firing device for securing elements is known from German published application DE 40 10 517 A1, comprising a driving piston which is guided in a working space, and comprising at least one combustion chamber, which adjoins the working space against the working drive direction of the driving piston, for the gas, wherein the combustion chamber has a venting opening discharging to the outside, the opening cross section of which is settable by a regulating slide.

BRIEF SUMMARY OF THE INVENTION

The object of the invention is to improve the efficacy and/or the functionality when driving securing elements using a fuel-operated firing device comprising at least one main combustion chamber for a fuel, a driving piston that can be driven out of the main combustion chamber in a firing direction by means of expandable gases, and a pre-chamber with which an ignition device is associated and in which a pressure acting on the main combustion chamber can build up prior to a fuel-air mixture being ignited in said main combustion chamber.

The object is achieved in a fuel-operated firing device for driving securing elements into a substrate, comprising at least one main combustion chamber for a fuel, a driving piston that can be driven out of the main combustion chamber in a firing direction by means of expandable gases, and a pre-chamber with which an ignition device is associated and in which a pressure acting on the main combustion chamber can build up prior to a fuel-air mixture being ignited in said main combustion chamber, in that a valve system is associated with the pre-chamber, by means of which valve system a maximum charge pressure in the pre-chamber can be varied in order to adjust the firing energy provided during the firing operation. The valve system is, for example, a venting valve, which is associated with the pre-chamber. In relation to a venting valve associated with the main combustion chamber, this provides the advantage, inter alia, that the firing energy may be more finely adjusted. This is to be attributed to the fact, for example, that less pressure is built up during the pre-combustion in the pre-chamber than during the main combustion in the main combustion chamber. Less venting thus occurs via the venting valve associated with the pre-chamber during equal valve opening duration. In addition, the requirements on the switching times of the venting valve associated with the pre-chamber are not as high, since the pre-combustion runs more slowly than the main combustion. The pre-combustion lasts, for example, approximately four times as long as the main combustion.

One preferred exemplary embodiment of the fuel-operated firing device is characterized in that the valve system is embodied as a manually actuated venting valve. The venting valve can be actuated, for example, directly by hand or via a positioning element, for example, a positioning wheel.

A further preferred exemplary embodiment of the fuel-operated firing device is characterized in that the valve system is embodied as a pressure regulating valve. The valve system is advantageously embodied as a controllable pressure limiting valve.

A further preferred exemplary embodiment of the fuel-operated firing device is characterized in that the valve system is electrically activated by an electronic regulator. The activation can take place via an electrical signal, which results from an analysis of a prior firing.

A further preferred exemplary embodiment of the fuel-operated firing device is characterized in that the electronic regulator comprises a user interface. A user of the firing device can advantageously perform the energy setting for a subsequent firing digitally via the user interface. The quality of the subsequent firing can thus be improved.

A further preferred exemplary embodiment of the fuel-operated firing device is characterized in that the valve system is connected with respect to control to a sensor device, which comprises at least one sensor. State variables, which are not constant during operation of the firing device, can be acquired using the sensor device. In this case, these are, for example, temperatures or pressures, which change depending on the location or the time.

A further preferred exemplary embodiment of the fuel-operated firing device is characterized in that the sensor device comprises at least one temperature sensor, one pressure sensor, one acceleration sensor, one velocity sensor, and/or one sensor for acquiring a height at which the firing device is presently located. The sensor for acquiring a height can also be referred to as a height meter. A present pressure in operation of the bolt firing device can be acquired using the pressure sensor. The pressure in the pre-chamber can advantageously be acquired using the pressure sensor. A present temperature in operation of the bolt firing device can be acquired using the temperature sensor. Thus, for example, a temperature in the pre-chamber can be acquired using the temperature sensor. However, state variables, such as the pressure or the temperature, in the main combustion chamber can also be acquired using the sensor device.

A further preferred exemplary embodiment of the fuel-operated firing device is characterized in that a valve system is associated with the main combustion chamber, by means of which valve system a maximum pressure in the main combustion chamber can be limited. The operating comfort in operation of the firing device can possibly also be controlled by the combination of the two valve systems. The valve system is preferably embodied as a variable overpressure valve. A desired maximum pressure during a combustion in the main combustion chamber can advantageously be set using the valve system.

A further preferred exemplary embodiment of the fuel-operated firing device is characterized in that the firing device comprises a control device, by means of which the firing energy is determined from a differential pressure between the main combustion chamber and an ambient pressure. The pre-chamber comprises at least one passage opening, which is closable by the control device. The pre-chamber is in particular connectable via an exhaust to the surroundings by means of the open passage opening. In addition, the control device is connected with respect to control pressure to the main combustion chamber. The control device is activated in operation of the firing device using the main combustion chamber pressure by the connection with respect to control pressure. When the pressure in the main combustion chamber reaches a certain pressure level, the at least one passage opening of the pre-chamber is automatically opened.

The invention furthermore relates to a method for operating an above-described fuel-operated firing device. Gas cartridges are used for providing the firing energy, for example. Due to the pre-combustion in the pre-chamber before the actual main combustion, the firing energy provided by the firing device can be elevated without the overall size of the firing device increasing. The efficiency of the firing device can be increased by the combustion at elevated pressure, since the combustion operations run more efficiently at higher pressure. It is made possible by the invention for the user of the firing device to set the firing energy of the firing device independently of presently prevailing environmental conditions in a simple manner. Applications having a lower energy requirement can thus advantageously also be operated consistently.

The invention also relates to a computer program product having program code for carrying out an above-described method, in particular when the program is executed in the controller of the firing device.

BRIEF DESCRIPTION OF THE SEVERAL VIEWS OF THE DRAWING(S)

Further advantages, features, and details of the invention result from the following description, in which various exemplary embodiments are described in detail with reference to the drawings. In the figures.

DETAILED DESCRIPTION OF THE INVENTION

Figure 1:
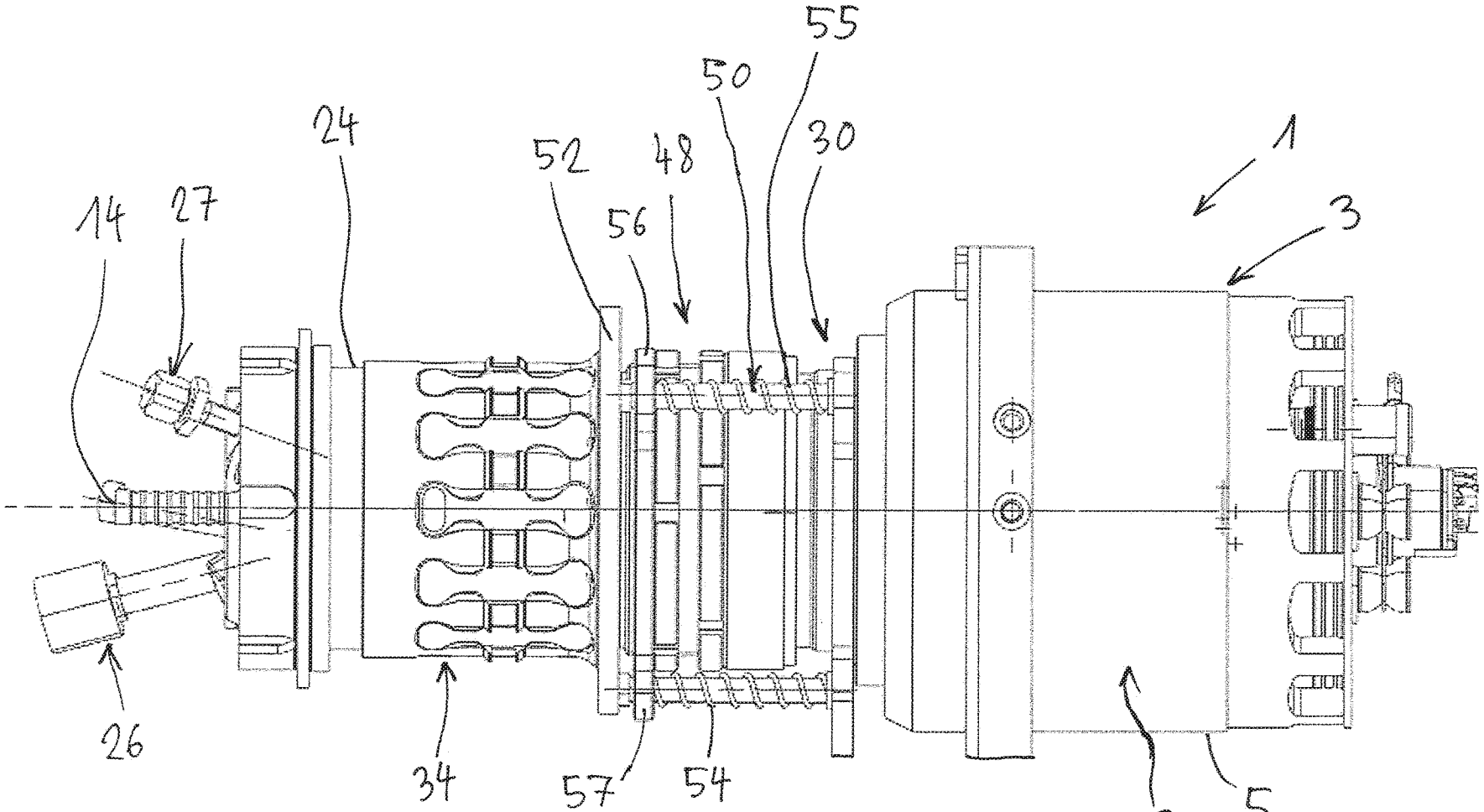
FIG. 1 shows a fuel-operated bolt firing device in a non-pressed-on starting state during flushing of a main combustion chamber in a top view.

A firing device 1 is illustrated very schematically in a longitudinal section in various operating states and views in FIGS. 1 to 7. The firing device 1 shown in FIGS. 1 to 7 can be operated using a combustible gas or using a liquid fuel which can be vaporized. The firing device 1 comprises a housing 3 comprising a main cylinder 5, which delimits a main combustion chamber 6. Gas and/or air can be supplied to the main combustion chamber 6 by means of an inlet device 8. In addition, an ignition device 9 is associated with the main combustion chamber 6.

A driving piston 10 is guided so it is movable back and forth in FIGS. 1 to 7 in the housing 3 of the firing device 1. The driving piston 10 comprises a piston rod 11, which originates from a piston head 12. A firing end 14 of the piston rod 11 facing away from the piston head or piston plate 12 is arranged in a bolt guide, which is used for guiding securing elements, which are also referred to as bolts. The firing end 14 of the piston rod 11 of the driving piston 10 is shown cutaway in FIG. 7.

The bolt guide having the piston rod 11 of the driving piston 10 arranged therein is also referred to as a firing mechanism. A securing element, such as a nail, bolt, or the like can be driven into a substrate (not shown) by means of the firing mechanism. The firing device 1 is pressed with its ball guide against the substrate and triggered before the firing of a securing element. A switch (not shown), which is also referred to as a trigger switch, is used to trigger a firing operation, for example. The switch is provided, for example, on a handle (also not shown) of the firing device 1.

A firing direction is indicated in FIGS. 1 to 7 by an arrow 15. During the firing of a securing element, the driving piston 10 is strongly accelerated using the piston rod 11 in the firing direction 15, to drive the securing element into the substrate. During the firing operation, the driving piston 10 is moved from its starting position shown in FIG. 1, which corresponds to a top or bottom dead center, into an end position, which corresponds to a bottom or top dead center.

A movement of the driving piston 10 to the right in FIGS. 1 to 7 is delimited by a housing-fixed piston stop 16. The top dead center of the driving piston 10 is defined by the piston stop 16. The piston stop 16 can be combined with a magnet device 17. The magnet device 17 is used, for example, for the purpose of holding the driving piston 10 with a predetermined holding force in its starting position shown in FIG. 1.

A movement of the driving piston 10 to the left is delimited by stop and/or damping elements 28, 29. The stop and/or damping elements 28 represent a cushion 110.

The piston head 12 comprises a first piston surface 21, which faces toward the main combustion chamber 6. A second piston surface 22, which faces away from the main combustion chamber 6, delimits a pre-chamber 25 in a pre-chamber cylinder 24. The pre-chamber cylinder 24 is part of the housing 3 of the firing device 1.

The pre-chamber 25 represents a pre-combustion chamber, with which an ignition device 26 and an inlet device 27 are associated. Moreover, the stop and/or damping elements 28, 29 are arranged in the pre-chamber 25. A combustible-gas-air mixture, which is ignited with the aid of the ignition device 26 in the pre-chamber 25, is supplied via the inlet device 27 to the pre-chamber or pre-combustion chamber 25.

The pre-chamber cylinder 24 comprises passage openings 31, 32, which enable, for example, the exit of exhaust gases from the pre-chamber 25. The passage openings 31, 32 are closable as needed by a control device 30. The control device 30 comprises a control sleeve 34, which has passage openings 37, 38.

Figure 6:
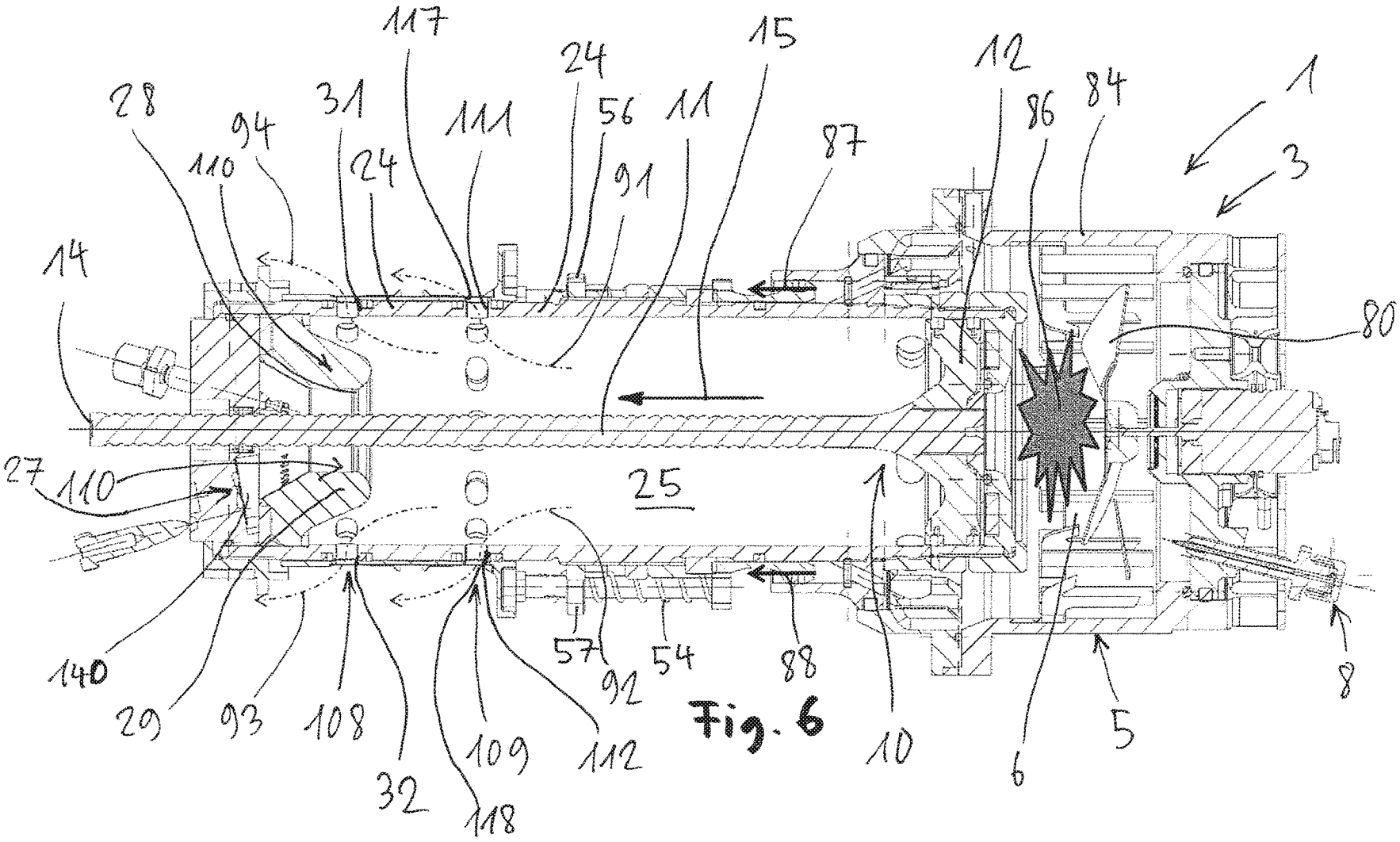
FIG. 6 shows the bolt firing device from FIGS. 1 to 5 during an ignition in the main combustion chamber in longitudinal section with open ventilation connections.
Figure 11:
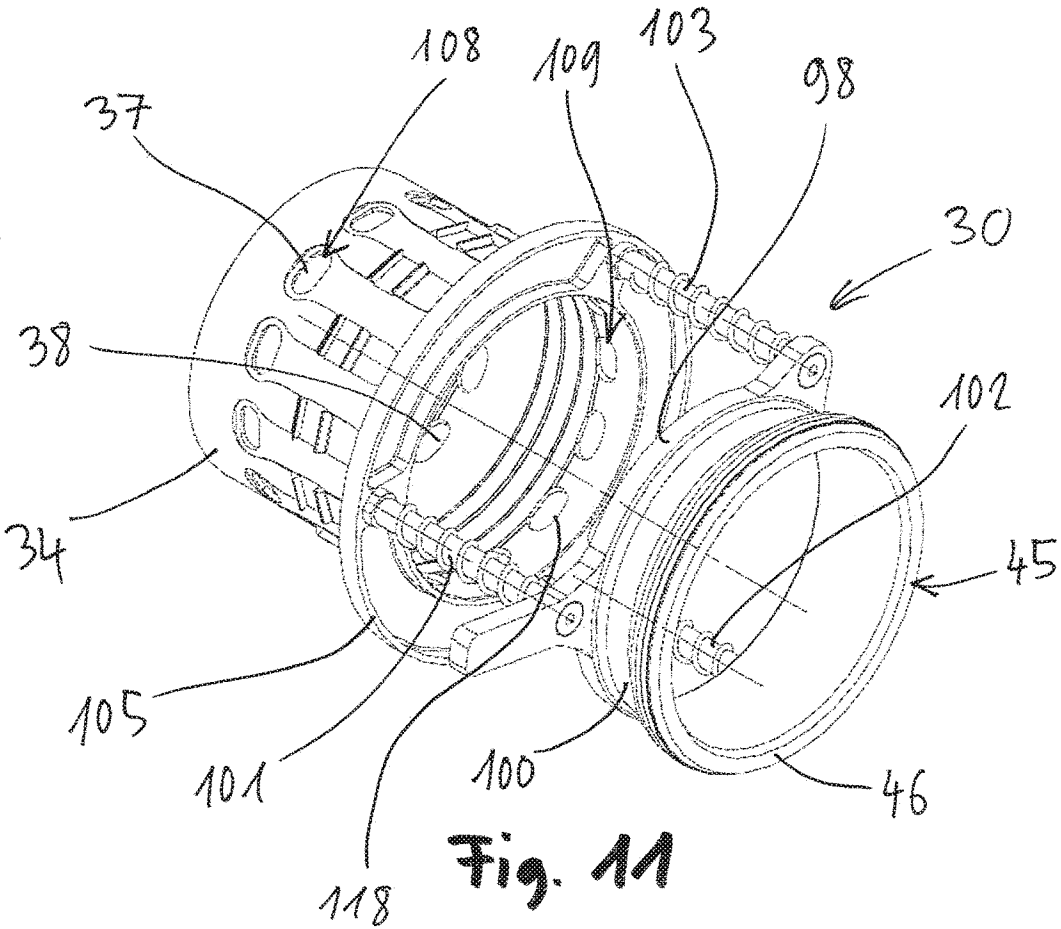
FIG. 11 shows a perspective illustration of the control device from FIGS. 8 and 9 without the check valve system, which is shown alone in FIG. 10.

If the passage openings 37, 38 of the control sleeve 34 are moved into line with the passage openings 31, 32, the passage openings 31, 32 are then open, as can be seen in FIG. 6. In FIGS. 1 to 5 and 7, passage openings 31, 32 are closed by the control sleeve 34. The control sleeve 34 essentially has the form of a right circular cylindrical jacket and is shown in detail in FIG. 11.

Overflow openings 41, 42 are provided between the pre-chamber 25 and the main combustion chamber 6. A valve system 43, 44 is associated with each of the overflow openings 41, 42. The valve systems 43, 44 are, for example, valve flaps, which enable a passage of an ignited air-fuel mixture from the pre-chamber 25 into the main combustion chamber 6.

The control system 30 comprises a control pressure surface 45, which is connected with respect to control pressure to the main combustion chamber 6. The control pressure surface 45 is embodied as a ring surface 46, which faces toward the main combustion chamber 6 radially outside the pre-chamber cylinder 24. The control pressure surface 45 is mechanically coupled to the control sleeve 30 by means of a coupling element 48.

The coupling element 48 is embodied as a slide 50, which is guided so it is movable back and forth in the horizontal direction on the pre-chamber cylinder 24 in FIGS. 1 to 7. The control pressure surface 45 embodied as a ring surface 46 is provided at a right end 51 of the slide 50 in FIGS. 1 to 7. The control sleeve 34 is secured at a left end 52 of the slide 50 in FIGS. 1 to 7.

The control device 30 furthermore comprises spring devices 54, 55, which are embodied, for example, as coiled compression springs. A housing-fixed stop 56, 57 is associated with each of the left ends of the spring devices 54, 55 in FIGS. 1 to 7. The housing-fixed stops 56, 57 are provided on the pre-chamber cylinder 24.

The spring devices 54, 55 are clamped between the housing-fixed stops 56, 57 and the right end 51 of the slide 50 having the control pressure surface 45. The slide 50 is therefore supported via the spring devices 54, 55 on the housing-fixed stops 56, 57.

Figure 2:
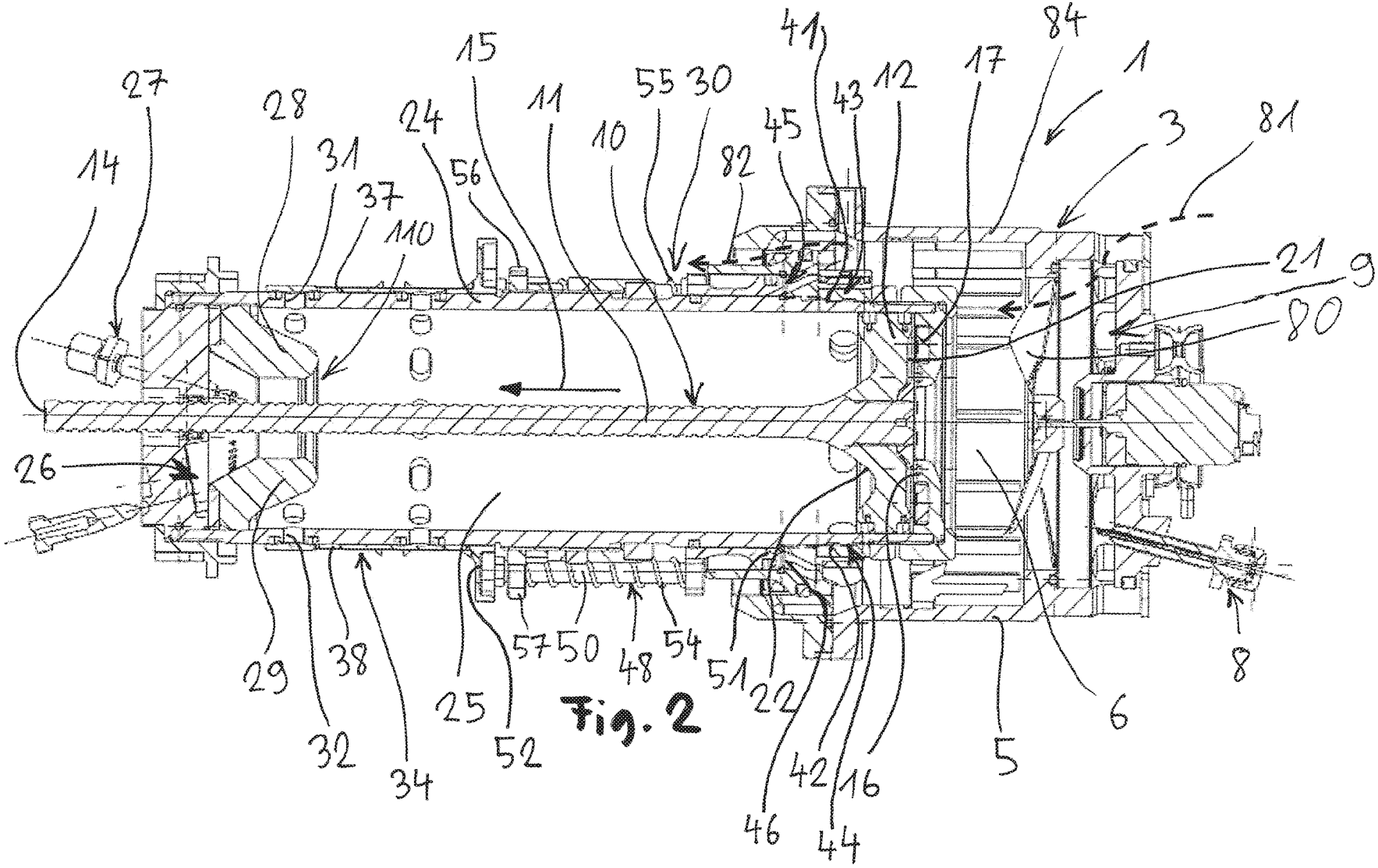
FIG. 2 shows the bolt firing device from FIG. 1 in longitudinal section.
Figure 3:
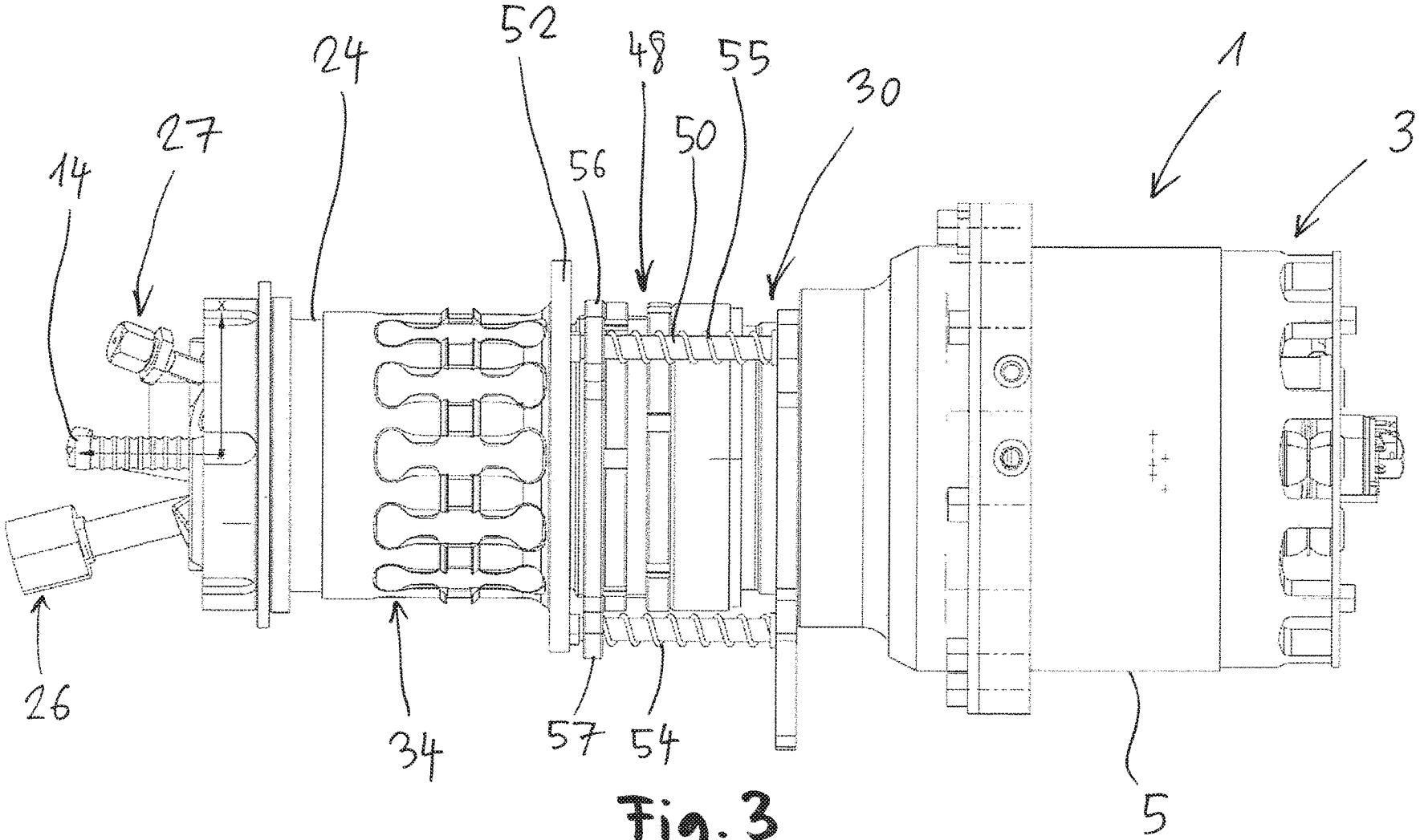
FIG. 3 shows the bolt firing device from FIGS. 1 and 2 in a pressed-on state having closed main combustion chamber in a top view.

The bolt firing device 1 is shown in a non-pressed-on state in FIGS. 1 and 2. Non-pressed-on state means that the firing end 14 of the driving piston 10 does not have a pressure force applied thereto by a bolt or a securing element, which is to be driven into a substrate. During the pressing on, the bolt firing device 1 is pressed with its firing end 14 against the substrate.

The main combustion chamber 6 is delimited by a combustion chamber sleeve 84, which is displaceable to a limited extent in the axial direction to enable flushing of the main combustion chamber 6. A ventilator 80 is arranged in the main combustion chamber 6.

In FIG. 2, the location of the combustion chamber sleeve 84 is such that the ventilator 80 generates an air stream 81, 82, which is indicated by arrows, from the device rear side, i.e., the right side in FIG. 2, through the main combustion chamber 6 into the environment. Exhaust gases are transported out of the main combustion chamber 6 after a firing operation by the air stream 81, 82. In addition, the air stream 81, 82 ensures cooling of the main combustion chamber 6.

Figure 4:
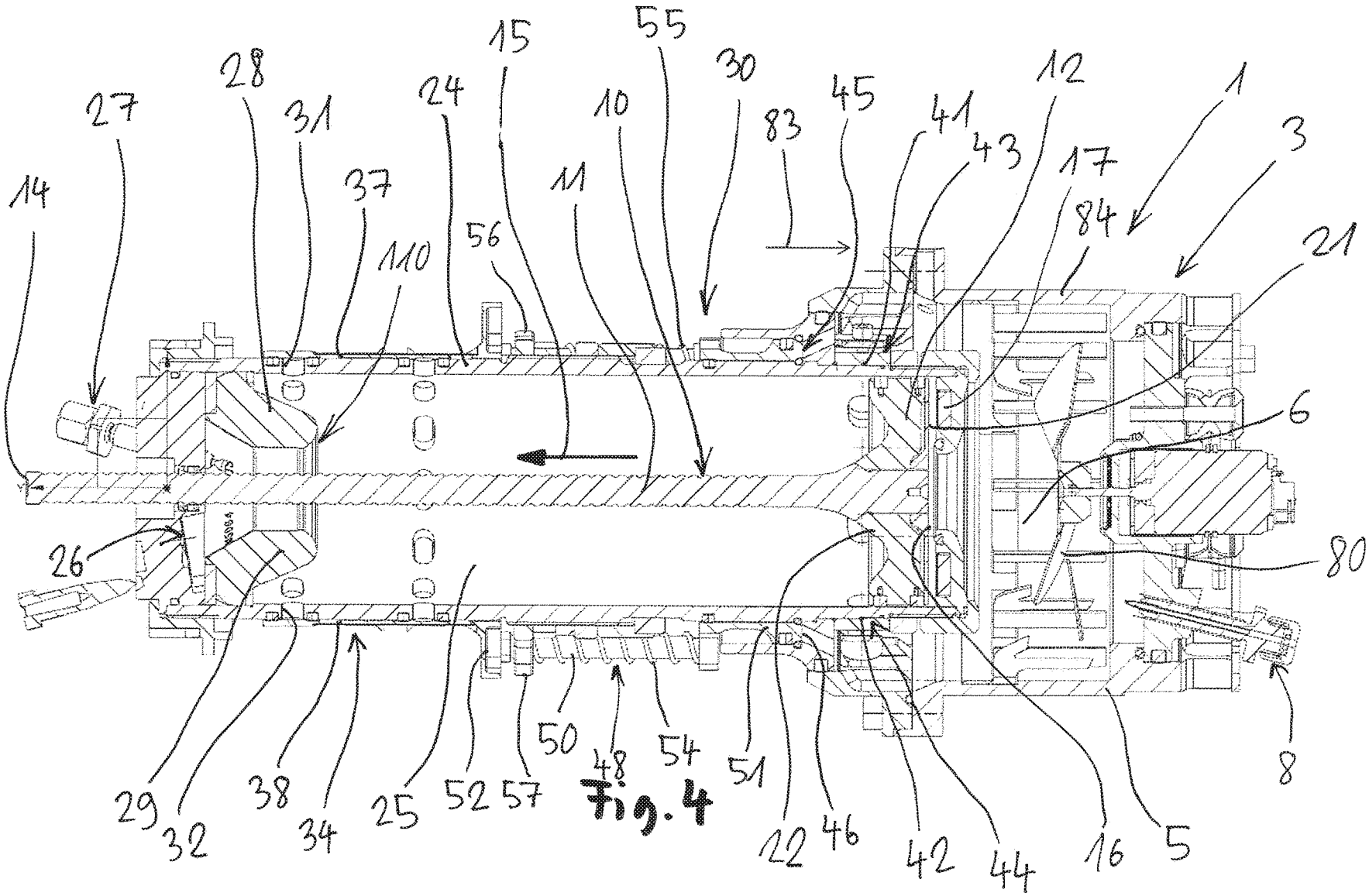
FIG. 4 shows the bolt firing device from FIG. 3 in longitudinal section.
Figure 5:
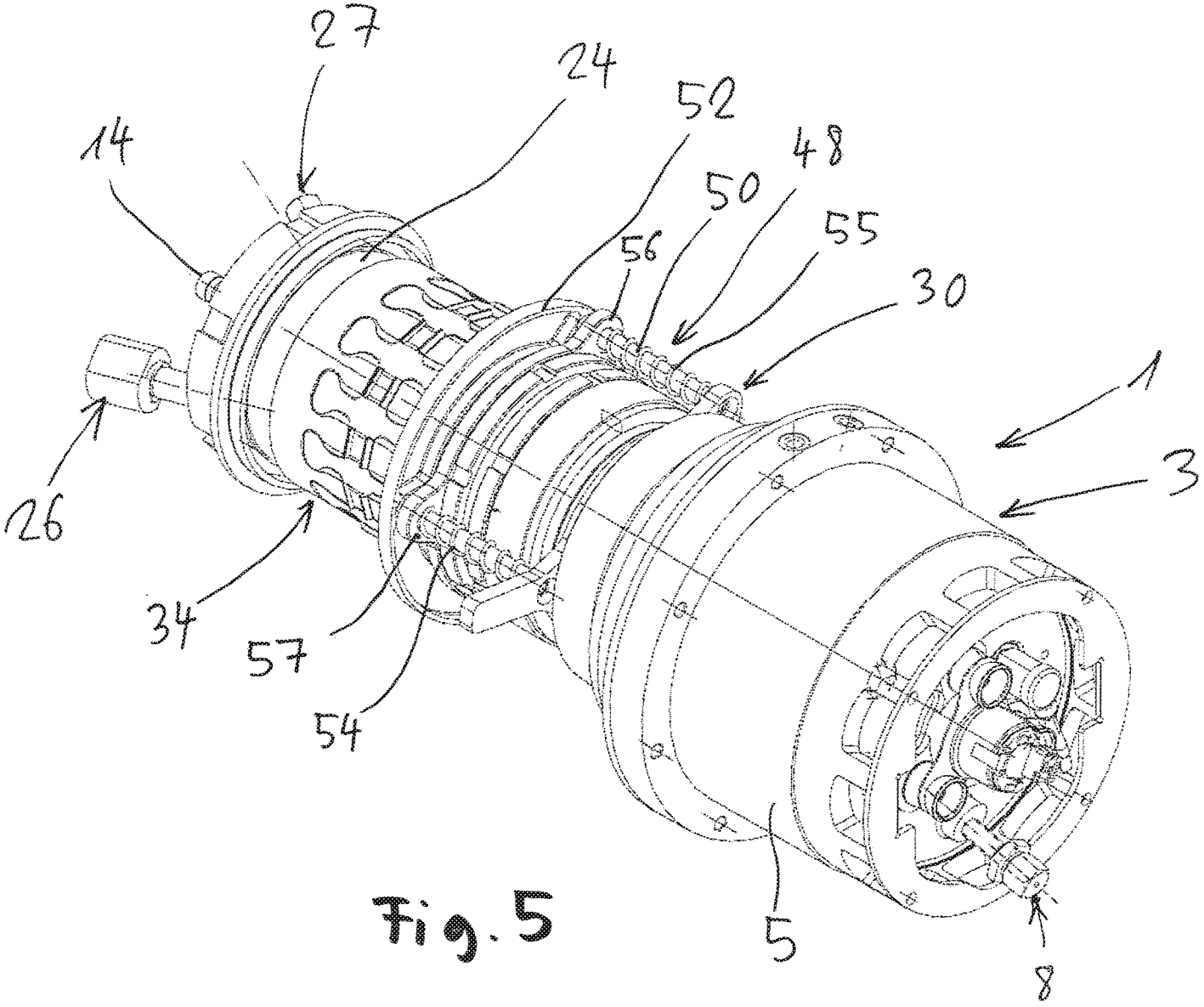
FIG. 5 shows the bolt firing device from FIGS. 3 and 4 in a perspective illustration.

The bolt firing device 1 is shown in the pressed-on state in FIGS. 3 to 6. In the pressed-on state, the tool tip of the bolt firing device 1 is pressed against a substrate. The combustion chamber sleeve 84 is displaced to the rear, i.e., to the right in FIG. 4, by the pressing-on movement, as indicated in FIG. 4 by an arrow 83. The main combustion chamber 6 is closed off from the environment by the movement 83 of the combustion chamber sleeve 84 to the rear.

Combustible gas is subsequently injected by means of the inlet device 27 into the pre-chamber 25 and by means of the inlet device 8 into the main combustion chamber 6. The ventilator 80 rotates in the main combustion chamber 6 during the injection of the combustible gas into the pre-chamber 25 and the main combustion chamber 6.

The ignition of the gas mixture is initiated by the ignition device 26 associated with the pre-chamber 25 in the vicinity of the cushion 110. After the ignition of the gas mixture in the pre-chamber 25, a flame front propagates, which travels from the side of the cushion 110 in the direction of the main combustion chamber 6, i.e., to the right in FIG. 4. The propagating flame front displaces unburned air/fuel mixture with a high pressure in front of it into the main combustion chamber 6 at the same time.

The overflow from the pre-chamber 25 into the main combustion chamber 6 takes place via the overflow openings 41, 42 with open valve systems 43, 44. The valve systems 43, 44 are embodied, for example, as check flaps, which release the overflow openings 41, 42, which are also referred to as ignition transfer openings, during the propagation of the laminar flame front.

When the flame front has reached the check flaps of the valve systems 43, 44, the flame can transfer the ignition by means of the check flaps into the main combustion chamber 6, whereby the main chamber combustion is initiated in the main combustion chamber 6. The main chamber ignition in the main combustion chamber 6 is indicated in FIG. 6 by a symbol 86.

During the main chamber ignition 86, the pressure rises in the main combustion chamber 6 and the control sleeve 34 is displaced forward, i.e., to the left in FIG. 6, as indicated by arrows 87, 88, against the force of the spring devices 54, 55, which are supported on the housing-fixed stops 56, 57. Two pressure relief connections 108, 109 of the pre-chamber 25 are opened by the movement 87, 88 of the control sleeve 34 forward.

The pre-chamber pressure escaping from the pre-chamber 25 via the open ventilation connections 108, 109 is indicated by arrows 91 to 94 in FIG. 6. The relief connections 108, 109 are also referred to as exhaust openings. The pre-chamber pressure can escape during the main chamber ignition 86 via the relief connections or exhaust openings 108, 109. The driving piston 10 is set into motion at high velocity during the main chamber ignition 86 and executes firing.

Figure 7:
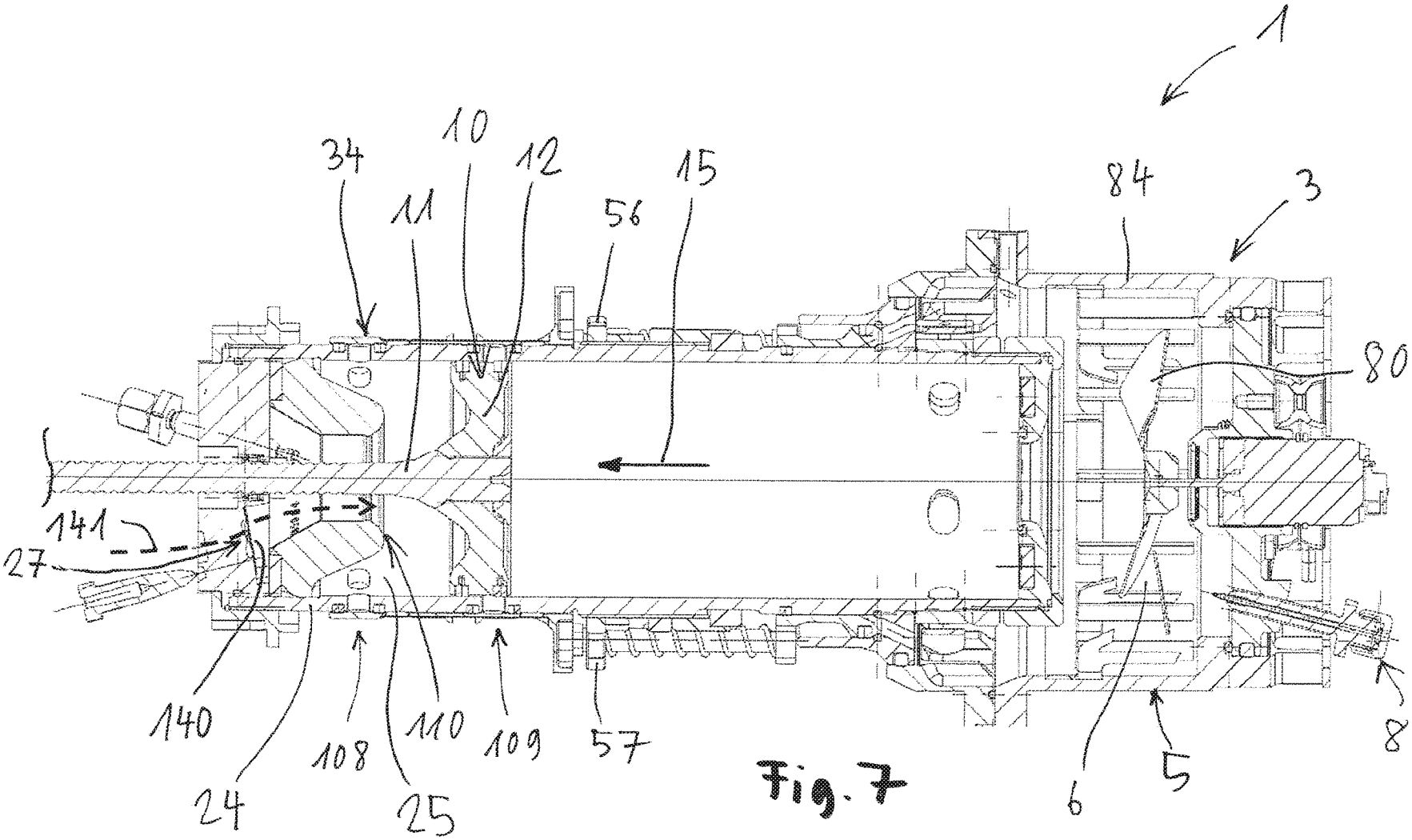
FIG. 7 shows the bolt firing device from FIGS. 1 to 6 in longitudinal section during a thermal return of a driving piston with closed ventilation connections.
Figure 9:
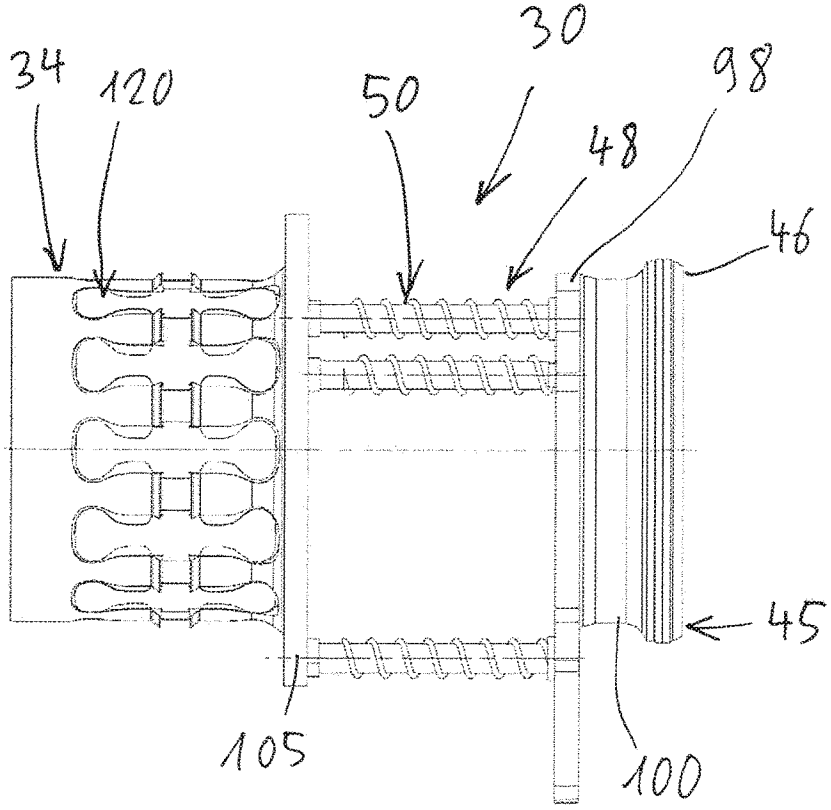
FIG. 9 shows the control device from FIG. 8 in a top view.
Figure 8:
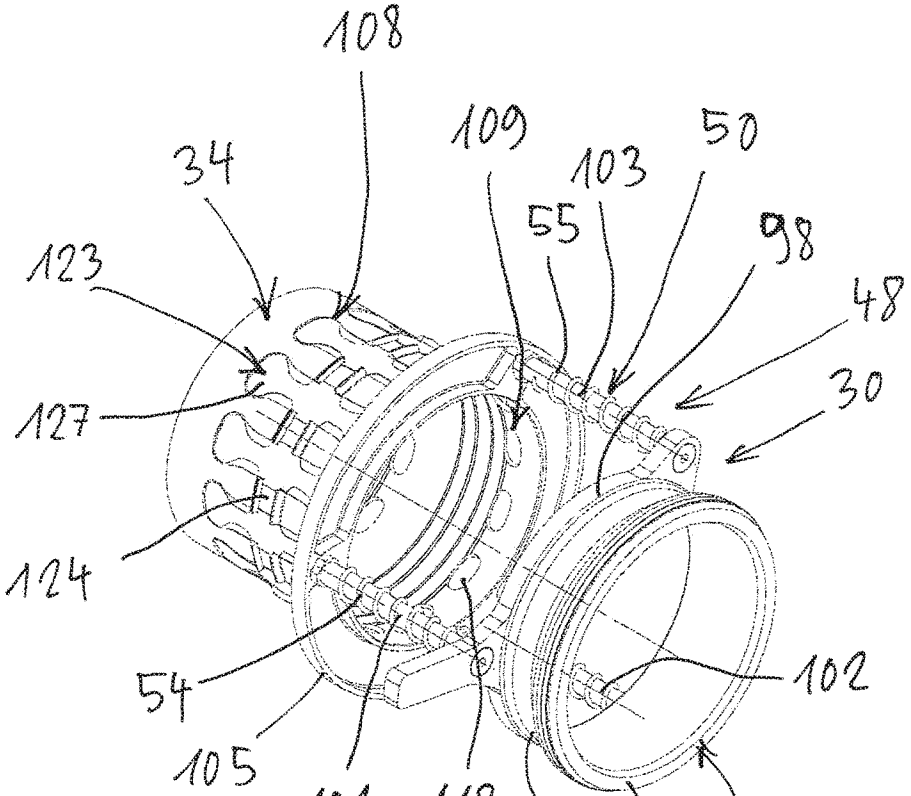
FIG. 8 shows a perspective illustration of a control device of the bolt firing device from FIGS. 1 to 6.

FIG. 7 shows the bolt firing device 1 during a thermal return of the driving piston 10 in longitudinal section. After the driving piston 10 has reached the top or bottom piston reversal point at the cushion 110, a main chamber residual pressure is vented via the relief connection 109. This has the result that the main combustion chamber pressure in the main combustion chamber 6 sinks to ambient pressure and the control sleeve 34 closes the exhaust openings or relief connections 108, 109 again in a pressure-controlled manner.

A partial vacuum arises in the main combustion chamber 6 due to cooling of the bolt firing device 1 after the firing. This partial vacuum in the main combustion chamber 6 has the result that the driving piston 10 is drawn or suctioned into its starting position. In this case, fresh air is drawn or suctioned into the pre-chamber 25 of the bolt firing device 1 through a pre-chamber inlet 140 at the left end of the pre-chamber cylinder 24 in FIG. 7. The suctioning in of the fresh air is indicated by an arrow 141 in FIG. 7.

A check valve acting on one side is advantageously associated with the pre-chamber inlet 140. The check valve comprises, for example, a relatively large spring leaf, which does enable suctioning of fresh air into the pre-chamber 25, but in the reverse direction prevents undesired flowing of pressurized fuel-air mixture out of the pre-chamber 25 into the environment.

When the bolt firing device 1 is lifted with its firing end 14, which is shown in FIG. 7, off of the substrate again, the combustion chamber sleeve 84 is again displaced such that the main combustion chamber 6 can be flushed using ambient air, as indicated by the arrows 81 and 82 in FIG. 2. A new firing cycle can subsequently be begun.

In FIGS. 8 to 11, the control device 30 is shown alone in various views. The control device 30 comprises the control sleeve 34, which is connected by means of the coupling element 48 to a coupling sleeve 100. The control pressure surface 45 embodied as a ring surface 46 is provided at a free end of the coupling sleeve 100, i.e., the right end of the coupling sleeve 100 in FIG. 9.

The coupling sleeve 100 is fixedly connected to a connecting flange 105 via slide rods 101, 102, 103, which partially represent the slide 50. The connecting flange 105 connects the control sleeve 34 to the slide rods 101 to 103. On the other side, the slide rods 101 to 103 are connected via a connecting flange 98 to the coupling sleeve 100.

Each slide rod 101 to 103 is associated with a spring device 54, 55 embodied as a compression spring. The spring devices 54, 55 are clamped in the installed state of the control device 30 between the connecting flange 98 and the housing-fixed stops 56, 57 on the pre-chamber cylinder 24.

The control sleeve 34 is used for the purpose of releasing the passage openings 31, 32; 117, 118 in the pre-chamber cylinder 24 as needed, as indicated in FIG. 6 by the arrows 91 to 94. For this purpose, the control sleeve 34 has the passage openings 37, 38; 117, 118, which are moved into line with the passage openings 31, 32; 111, 112 in the pre-chamber cylinder 24 to open the ventilation connections 108, 109.

Figure 10:
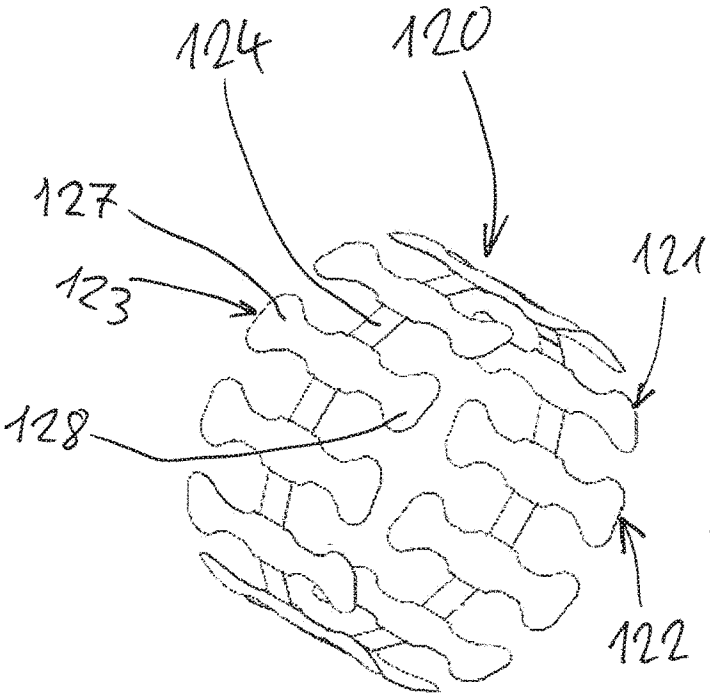
FIG. 10 shows a perspective illustration of a check valve system, which is integrated in the control device of FIGS. 8 and 9.

It can be seen in FIG. 10 that the check valve system 120 comprises valve elements 121 to 123 which are connected to one another by a connecting ring body 124. Each of the valve elements 121 to 123 comprises two slide elements 127, 128, which are associated with passage openings 37; 118 of the two relief connections 108; 109.

The valve elements 121 to 123 comprising the closing elements 127, 128 are integrally formed from spring steel. The production of the valve elements 121 to 123 comprising the closing elements 127, 128 is performed, for example, by laser beam cutting. The connecting ring body 124 can also be produced from a spring steel material by laser beam cutting.

The system behavior and/or the total energy of the firing device 1 is not constant, in particular as a result of environmental influences. In the case of a regulation of the overflowing gas quantity between the pre-chamber 25 and the main combustion chamber 6, solely a relative value is tapped between them, which results because of the conditions prevailing before the combustion. However, since the firing energy is determined by the differential pressure between the main combustion chamber and the ambient pressure, a non-constant energy output of the firing device 1 can occur, as has been found in experiments and studies carried out in the scope of the present invention.

A firing device and method or a system are provided by the invention, which enable a constant setting of the energy to the user of the firing device 1. The firing device 1 thus advantageously supplies a consistent predefined firing energy even in the event of different environmental conditions.

Figure 12:
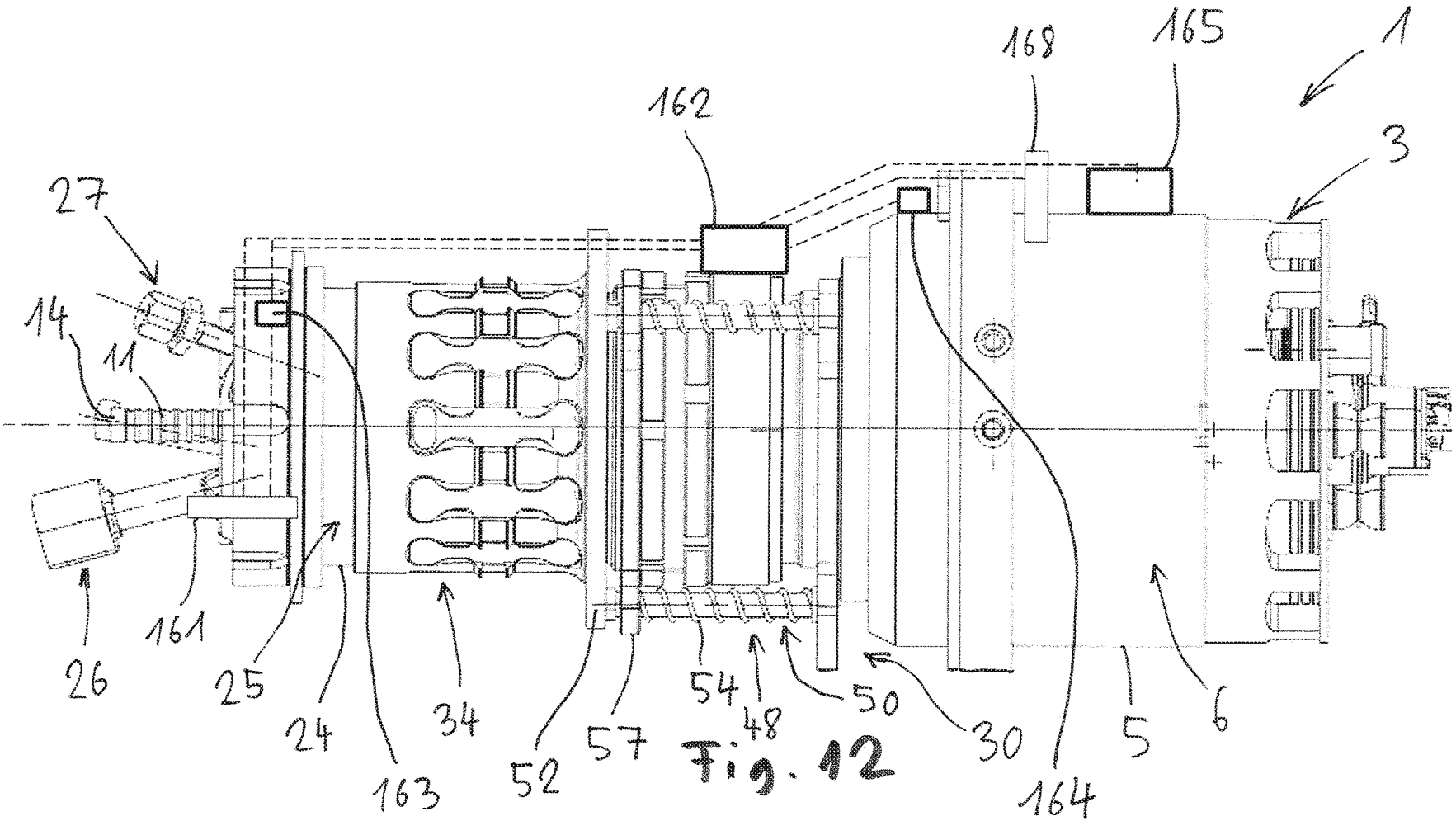
FIG. 12 shows the bolt firing device from FIG. 1 according to an exemplary embodiment having an electronic regulation of pressure limiting valves.

A valve system, which is associated with the pre-chamber 25, is indicated by a rectangle 161 in FIG. 12. The valve system 161 is attached at the left end of the pre-chamber cylinder 24 in FIG. 12. The valve system 161 is arranged radially outside the piston rod 11 of the driving piston in this case.

The valve system 161 is connected with respect to control to an electronic regulator, which is indicated by a rectangle 162. Sensors, which are connected with respect to control to the electronic regulator 162, are indicated by further rectangles 163, 164. The sensor 163 is associated with the pre-chamber 25. The sensor 164 is associated with the main combustion chamber 6.

In addition, a valve system 168, which is also connected with respect to control to the electronic regulator 162, is associated with the main combustion chamber 6. The two valve systems 161 and 168 are embodied as pressure limiting valves. The pressure limiting valves 161, 168 are electronically activated via the electronic regulator 162. Environmental influences can be acquired using the sensors 163, 164. For this purpose, the sensors 163, 164 are embodied, for example, as temperature sensors or as pressure sensors.

The pressure limiting valves 161, 168 are adjusted in accordance with environmental influences by means of the electronic regulator 162 in operation of the firing device 1. Thus, for example, at low temperatures, the pressure limiting valve 161 associated with the pre-chamber 25 is regulated such that a pre-charging pressure of 0.7 bar is reached. At high temperatures, the pressure limiting valve 161 is activated accordingly, to enable a higher pre-charging pressure, since at high temperatures less gas is available for combustion in the firing device 1 as a result of the air density.

The sensors 163, 164 can also be embodied as pressure sensors, which measure the maximum pressures in the pre-chamber 25 or in the main combustion chamber 6. The maximum pressure occurring in the corresponding chamber is referred to as the maximum pressure in this context. The maximum pressure is analyzed after a completed firing in the electronic regulator 162. Items of information about the energy which was available for the firing are obtained therefrom. Before a subsequent firing, one of the pressure limiting valves 161, 168 can then be regulated such that the device energy defined by the electronic regulator 162 is available. Alternatively, both pressure limiting valves 161, 168 can be regulated accordingly.

A user interface, which is connected with respect to control to the electronic regulator 162, is indicated by a rectangle 165. The user interface 165 advantageously enables the user of the firing device 1 to electronically set the energy of the firing device 1. For this purpose, the information is transferred from the user interface 165 to the electronic regulator 162. At least one of the pressure limiting valves 161, 168 is then set by means of the electronic regulator 162.

Figure 13:
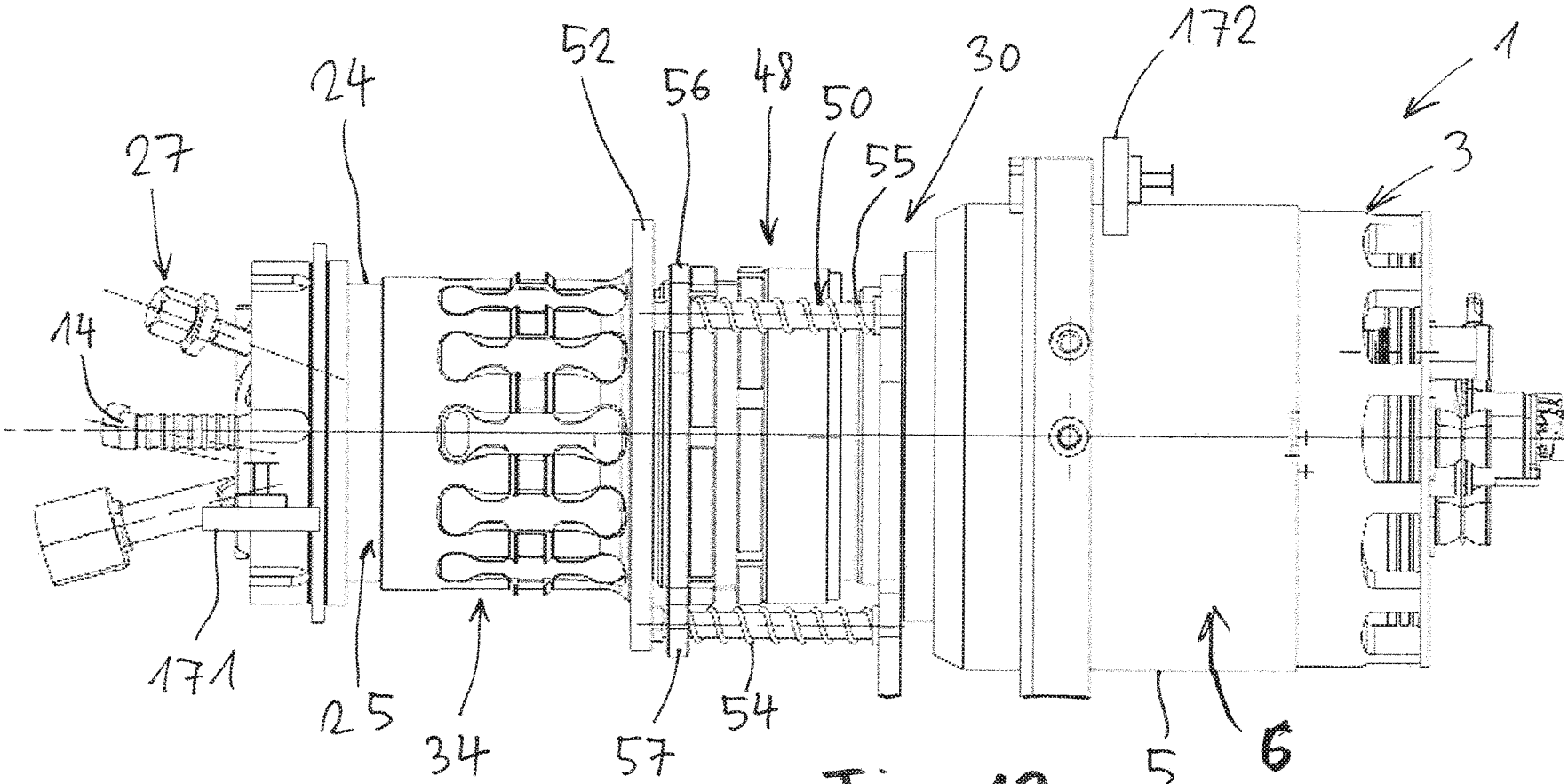
FIG. 13 shows the bolt firing device from FIG. 1 according to an exemplary embodiment having a manual regulation of pressure limiting valves.

In the bolt firing device 1 shown in FIG. 13, a valve system indicated by a rectangle 171 is associated with the pre-chamber 25. A valve system 172, also indicated by a rectangle, is associated with the main combustion chamber 6. It is indicated by actuation symbols at the valve systems 171, 172 that the valve systems can be adjusted manually by the user or employer. The adjustment or setting of the valve systems 171, 172 takes place, for example, via positioning wheels or a common positioning wheel, via which both valve systems 171, 172 can be set jointly. The two valve systems 171, 172 are embodied as pressure limiting valves.

It is to be noted that the valve systems 168; 172 associated with the main combustion chamber 6 in FIGS. 12 and 13 can also be omitted. The effect according to the invention also results if the valve system 161; 171 is only associated with the pre-chamber 25.

The maximum charging pressure can be varied during a pressure buildup phase using the valve systems 161; 171, optionally in combination with the valve systems 168; 172. In the pressure buildup phase, a fuel-air mixture is combusted with a laminar flame front in the pre-chamber 25. The maximum pressure can be limited during a main chamber combustion by means of the optional valve system 168; 172.

The invention claimed is:

1. A fuel-operated firing device for driving securing elements into a substrate, comprising at least one main combustion chamber for a fuel; a driving piston that can be driven out of the at least one main combustion chamber in a firing direction by expandable gases, a pre-chamber with which an ignition device is associated and in which a pressure acting on the at least one main combustion chamber can build up prior to a fuel-air mixture being ignited in the at least one main combustion chamber; and, a valve system associated with the pre-chamber; wherein a maximum charge pressure in the pre-chamber is varied by the valve system to adjust firing energy provided during a firing operation.

2. The fuel-operated firing device as claimed in claim 1, wherein the valve system is a manually actuated venting valve.

3. The fuel-operated firing device as claimed in claim 2, wherein the valve system is electrically activated by an electronic regulator.

4. The fuel-operated firing device as claimed in claim 3, wherein the electronic regulator comprises a user interface.

5. The fuel-operated firing device as claimed in claim 2, wherein the valve system is connected to control a sensor device, which comprises at least one sensor.

6. The fuel-operated firing device as claimed in claim 1, wherein the valve system is a pressure regulating valve.

7. The fuel-operated firing device as claimed in claim 6, wherein the valve system is electrically activated by an electronic regulator.

8. The fuel-operated firing device as claimed in claim 7, wherein the electronic regulator comprises a user interface.

9. The fuel-operated firing device as claimed in claim 6, wherein the valve system is connected to control a sensor device, which comprises at least one sensor.

10. The fuel-operated firing device as claimed in claim 1, wherein the valve system is electrically activated by an electronic regulator.

11. The fuel-operated firing device as claimed in claim 10, wherein the electronic regulator comprises a user interface.

12. The fuel-operated firing device as claimed in claim 11, wherein the valve system is connected to control a sensor device, which comprises at least one sensor.

13. The fuel-operated firing device as claimed in claim 10, wherein the valve system is connected to control a sensor device, which comprises at least one sensor.

14. The fuel-operated firing device as claimed in claim 1, wherein the valve system is connected to control a sensor device, which comprises at least one sensor.

15. The fuel-operated firing device as claimed in claim 14, wherein the sensor device comprises at least one temperature sensor, one pressure sensor, one acceleration sensor, one velocity sensor, and/or one sensor for capturing a height at which the firing device is located.

16. The fuel-operated firing device as claimed in claim 15, wherein the valve system is associated with the at least one main combustion chamber, by which a maximum pressure in the at least one main combustion chamber can be limited.

17. The fuel-operated firing device as claimed in claim 15, wherein the firing device comprises a control device by which the firing energy is determined from a differential pressure between the at least one main combustion chamber and an ambient pressure.

18. A method for operating a fuel-operated firing device for driving securing elements into a substrate, the device comprising at least one main combustion chamber for fuel; a driving piston that can be driven out of the at least one main combustion chamber in a firing direction by expandable gases, a pre-chamber with which an ignition device is associated and in which a pressure acting on the at least one main combustion chamber can build up prior to a fuel-air mixture being ignited in the at least one main combustion chamber; and, a valve system associated with the pre-chamber; wherein a maximum charge pressure in the pre-chamber is varied by the valve system to adjust firing energy provided during a firing operation, the method comprising varying the maximum charge pressure in the pre-chamber.

19. A computer program product comprising program code for carrying out the method as claimed in claim 18.

20. The computer program product as claimed in claim 19, wherein the program is executable in a controller of the firing device.

* * * * *